US012319476B1

(12) United States Patent
Cheney et al.

(10) Patent No.: US 12,319,476 B1
(45) Date of Patent: Jun. 3, 2025

(54) PACKAGING ASSEMBLY

(71) Applicant: Pratt Corrugated Holdings, Inc., Brookhaven, GA (US)

(72) Inventors: Connor Cheney, Milford, MI (US); Ryan Richmond, Livonia, MI (US); C. Samuel Simich, South Lyon, MI (US)

(73) Assignee: Pratt Corrugated Holdings, Inc., Brookhaven, GA (US)

( * ) Notice: Subject to any disclaimer, the term of this patent is extended or adjusted under 35 U.S.C. 154(b) by 0 days.

(21) Appl. No.: 18/937,265

(22) Filed: Nov. 5, 2024

Related U.S. Application Data

(63) Continuation of application No. 18/734,872, filed on Jun. 5, 2024.

(51) Int. Cl.
*B65D 5/20* (2006.01)

(52) U.S. Cl.
CPC ..... *B65D 5/20* (2013.01)

(58) Field of Classification Search
CPC ..... B65D 5/20; B65D 5/0045; B65D 5/307; B65D 5/443; B65D 5/002; B65D 5/22; B65D 5/301; B65D 5/302; B65D 5/304; B65D 5/5021; B65D 5/5038; B65D 5/542; B65D 81/053; Y10S 229/918; Y10S 229/919; Y10S 229/915
USPC ..... 229/165, 918, 191, 195, 196, 919, 179, 229/198.2, 190, 178, 194, 915, 242, 916; 206/509, 512, 557
See application file for complete search history.

(56) References Cited

U.S. PATENT DOCUMENTS

| | | | | |
|---|---|---|---|---|
| 1,126,246 | A * | 1/1915 | Maier | B65D 5/302 229/196 |
| 3,034,698 | A | 5/1962 | Forrer | |
| 3,756,502 | A | 9/1973 | Swanson et al. | |
| 5,487,505 | A | 1/1996 | Nilsson | |
| 5,671,883 | A | 9/1997 | Philips | |
| 5,913,474 | A * | 6/1999 | Chu | B65D 5/0035 229/198.2 |
| 5,996,885 | A | 12/1999 | Chu | |
| 6,474,541 | B1 * | 11/2002 | Chu | B65D 5/0045 229/196 |
| 6,575,356 | B2 | 6/2003 | McClure | |
| 6,651,875 | B2 | 11/2003 | Chu | |
| 6,675,970 | B1 * | 1/2004 | Nemoto | B65D 5/5061 206/592 |
| 6,824,042 | B2 | 11/2004 | Chu | |
| 6,868,968 | B1 * | 3/2005 | Casanovas | B65D 5/321 229/164 |
| 7,731,025 | B2 * | 6/2010 | Cheng | B65D 81/053 206/521 |
| 8,887,982 | B2 * | 11/2014 | Smith | B65D 5/443 229/109 |
| D814,927 | S | 4/2018 | Campagnolo | |

(Continued)

FOREIGN PATENT DOCUMENTS

| | | |
|---|---|---|
| DE | 7811443 | 5/1979 |
| FR | 2795390 | 12/2000 |
| GB | 971565 | 9/1964 |

*Primary Examiner* — Christopher R Demeree
(74) *Attorney, Agent, or Firm* — Taylor English Duma LLP

(57) ABSTRACT

A packaging element formed from a blank includes a bottom panel, a first side panel connected to the bottom panel, at least one support assembly connected to the first side panel, at least one end panel connected to the bottom panel, and each end panel secured to the packaging element.

30 Claims, 12 Drawing Sheets

(56) References Cited

U.S. PATENT DOCUMENTS

| | | | |
|---|---|---|---|
| 2022/0411127 | A1 | 12/2022 | Lazzareschi |
| 2024/0076096 | A1 | 3/2024 | Hokanson |

* cited by examiner

PACKAGING ASSEMBLY

CROSS-REFERENCE TO RELATED APPLICATIONS

The present application is a continuation of U.S. application Ser. No. 18/734,872, filed Jun. 5, 2024, which is hereby specifically incorporated by reference herein in its entirety.

TECHNICAL FIELD

This disclosure relates to packaging. More specifically, this disclosure relates to packaging for large and heavy items.

BACKGROUND

Packaging elements can be designed for a variety of applications and purposes. Various packaging elements need to be loaded from the top, side, or bottom in various applications. In some cases, access locations can be different from loading locations. Such requirements can cause challenges if the packaged elements are particularly heavy. Additionally, stacking of such packaging elements can require additional structural elements that can require additional parts and assembly.

SUMMARY

It is to be understood that this summary is not an extensive overview of the disclosure. This summary is exemplary and not restrictive and is intended to neither identify key or critical elements of the disclosure nor delineate the scope thereof. The sole purpose of this summary is to explain and exemplify certain concepts of the disclosure as an introduction to the following complete and extensive detailed description.

Disclosed is a blank that can include a bottom panel; at least one side panel connected to the bottom panel, each side panel connected to the bottom panel by a side panel line; at least one support assembly panel, each support assembly panel connected to one side panel by a support assembly line; and, at least one end panel connected to the bottom panel by an end panel line, wherein each support assembly panel can include a first snap panel connected to one side panel by the support assembly line; at least one intermediary snap panel connected as part of the support assembly in bending relationship with the first snap panel; and a second snap panel distal to the first snap panel and connected as part of the support assembly in bending relationship with the at least one intermediary snap panel, wherein each end panel is removably connected to the bottom panel by the end panel line.

Also disclosed is a packaging formed from a blank that can include a bottom panel; a side panel connected to the bottom panel; a support assembly connected to the side panel, the support assembly configured to be separable from the side panel; and an end panel connected to the bottom panel, the end panel configured to be separable from the bottom panel.

Also disclosed is a packaging element that can include a bottom panel, the bottom panel being rectangular; a first side panel arranged orthogonally to the bottom panel; a second side panel arranged orthogonally to the bottom panel and opposite the first side panel, wherein an opening is defined between the first side panel and the second side panel; a first support assembly releasably connected to the first side panel and configured to be positioned between the bottom panel and a cover of the opening; a second support assembly releasably connected to the second side panel and configured to be positioned between the bottom panel and the cover; an end panel releasably connected to the bottom panel.

Also disclosed is a method of forming packaging that can include the steps of obtaining a blank, the blank including a bottom panel, a side panel connected to the bottom panel by a side panel line, a support assembly panel connected to the side panel by a support assembly line, and an end panel connected to the bottom panel by an end panel line, wherein the support assembly panel defines a snap receiver, and wherein the blank can include a snap arranged to couple to the snap receiver; bending the support assembly panel to form a first support assembly; bending the side panel with respect to the bottom panel along the side panel line such that the side panel is arranged orthogonally with respect to the bottom panel; bending the end panel with respect to the bottom panel along the end panel line such that the end panel is arranged orthogonally with respect to the bottom panel and in contact with the first support assembly; securing the end panel in contact with the first support assembly.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and, together with the description, explain various principles of the disclosure. The drawings are not necessarily drawn to scale. Corresponding features and components throughout the figures may be designated by matching reference characters for the sake of consistency and clarity.

DETAILED DESCRIPTION

Figure 1:
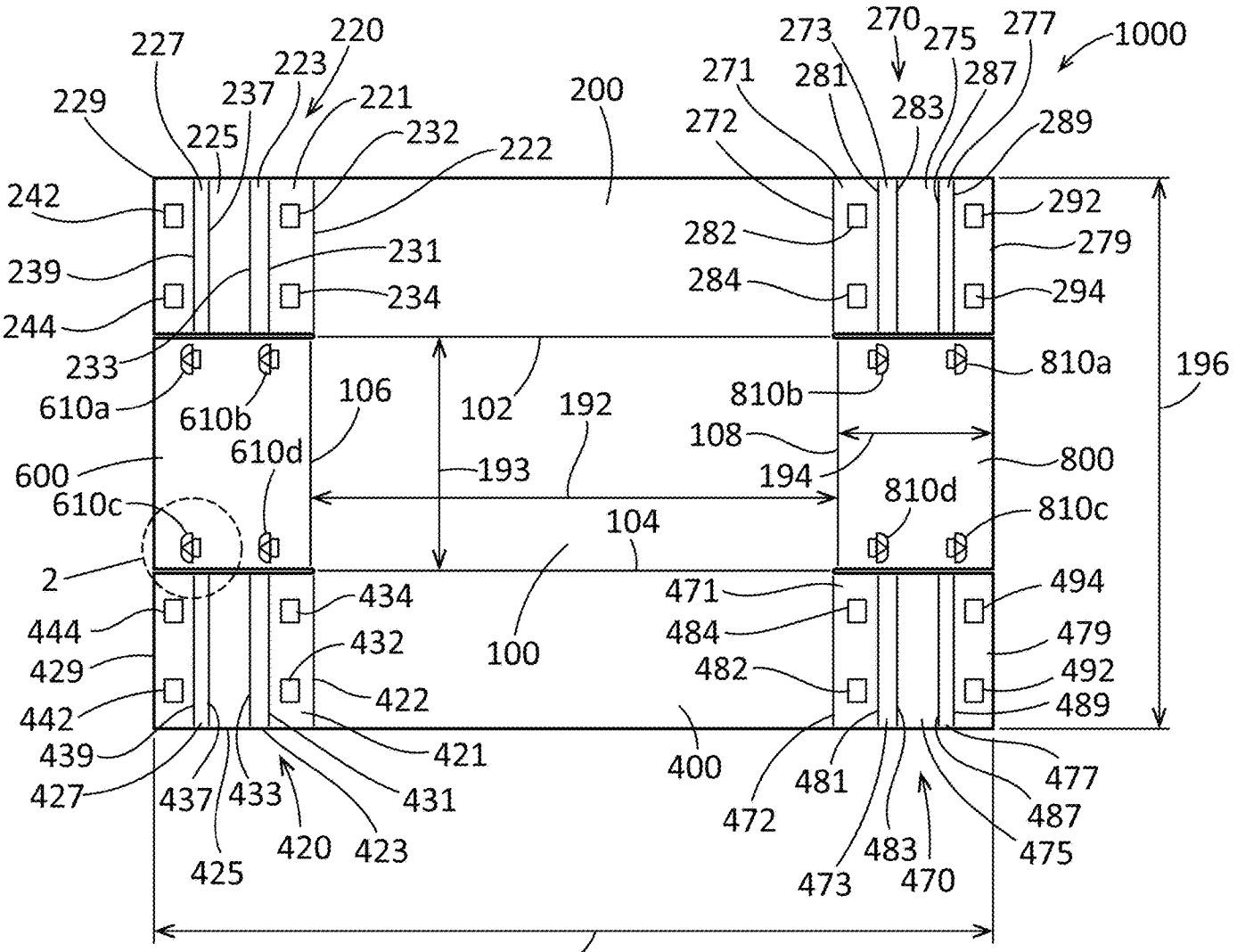
FIG. 1 is a plan view of a blank formable into a tray in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an," and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes, and between different models, the tolerance for a particular measurement of a particular component can fall within a range of tolerances.

As used herein, the terms "optional" or "optionally" mean that the subsequently described event or circumstance may or may not occur and that the description comprises instances where said event or circumstance occurs and instances where it does not.

The word "or" as used herein means any one member of a particular list and also comprises any combination of members of that list. The phrase "at least one of A and B" as used herein means "only A, only B, or both A and B"; while the phrase "one of A and B" means "A or B."

As used herein, unless the context clearly dictates otherwise, the term "monolithic" in the description of a component means that the component is formed as a singular component that constitutes a single material without joints or seams. Unless otherwise specified herein, any structure disclosed in the drawings or in the written description as being so formed can be monolithic whether or not such an explicit description of the structure is included herein.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of a break check valve nearest to an outlet of the valve, and "rear" is the end of the break check valve which can be opposite or distal the front. "Horizontal" or "horizontal orientation" describes that which is in a plane extending from left to right and aligned with the horizon. "Vertical" or "vertical orientation" describes that which is in a plane which can be angled at 90 degrees to the horizontal.

Disclosed is a packaging assembly and associated methods, systems, devices, and various apparatus. The packaging assembly can be formed of various blanks. It would be understood by one of skill in the art that the disclosed packaging assembly is described in but a few exemplary embodiments among many. No particular terminology or description should be considered limiting on the disclosure or the scope of any claims issuing therefrom.

One embodiment of a blank 1000 is disclosed and described with reference to FIG. 1. In various aspects, the blank 1000 can be comprised of corrugated cardboard. In various aspects, the blank 1000 can be made of varying materials including various paperboards, fiberboards, cardboards, card stock, various plastics, and various other materials that would be understood by one of skill in the art to be applicable for the uses described herein. No particular material should be considered limiting on the scope of the disclosure herein.

The blank 1000 can comprise an assortment of panels. The blank 1000 can be formable into a tray in the current aspect. A bottom panel 100 can be seen at the center of the blank 1000. The bottom panel 100 can be rectangular in shape in various aspects. A side panel 200 can be connected to the bottom panel 100 by a line 102.

In various aspects, a "line" or a plurality of "lines" can refer to bends, perforations, cuts, creases, or combinations of bends, cuts, perforations, and creases. In various aspects, perforations can be ⅜ inches; in various aspects, perforations can be ¼ inches; in various aspects, cuts can be ½ inches; in various aspects, perforations and cuts can be of variant sizes. If not specified in the disclosure, one of skill in the art would understand that various lines described herein can be interchangeable between various aspects of the current disclosure, and one of skill in the art would not understand any particular embodiment of "line" or "lines" to be limiting on the scope of the disclosure.

A side panel 400 can be connected to the bottom panel 100 by a line 104. In various aspects, lines 102, 104 can be bend lines. In various aspects, each side panel 200, 400 can be rectangular in shape. In various aspects, each side panel 200, 400 can be about the same size as the other side panel 400, 200 and can be of a length that is about the same as the bottom panel 100.

An end panel 600 can be connected to the bottom panel 100 by a line 106. The end panel 600 can be about rectangular in shape and can be of about the same width as the bottom panel 100. An end panel 800 can be connected to the bottom panel 100 by a line 108.

The end panel 800 can be about rectangular in shape and can be of about the same width as the bottom panel 100. In various aspects, each end panel 600, 800 can be about the same size as the other side panel 800, 600.

One of skill in the art would understand that the lines 106, 108 can be of various compositions in various aspects of the current disclosure. In the current aspect, each of the lines 106, 108 can be a perforated line. The perforated line can be arranged such that each end panel 600, 800 can be separated from the bottom panel 100 by sufficient force applied as will be discussed in further depth elsewhere in this disclosure.

A support assembly panel 220 can be connected to the side 200 by a line 222. A support assembly panel 270 can be connected to the side 200 by a line 272. A support assembly panel 420 can be connected to the side 200 by a line 422. A support assembly panel 470 can be connected to the side 400 by a line 472. One of skill in the art would understand that the lines 222, 272, 422, 472 can be of various compositions in various aspects of the current disclosure. In the current aspect, each of the lines 222, 272, 422, 472 can be a perforated line. The perforated line can be arranged such that each end panel support assembly panel 220, 270, 420, 470 can be separated from the sides 200, 400 by sufficient force applied as will be discussed in further depth elsewhere in this disclosure.

The support assembly panel 220 can comprise a first snap panel 221, a first boxing panel 223, an internal panel 225, a second boxing panel 227, and a second snap panel 229. The first snap panel 221 can be connected to the first boxing panel 223 by a line 231. The first boxing panel 223 can be connected to the internal panel 225 by a line 233. The internal panel 225 can be connected to the second boxing panel 227 by a line 237. The second boxing panel 227 can be connected to the second snap panel 229 by a line 239. In the current aspect, the lines 231, 233, 237, 239 can be bend lines. The first snap panel 221 can define a first snap receiver 232 and a second snap receiver 234. Each snap receiver 232, 234 can be a void defined in the first snap panel 221. Similarly, the second snap panel 229 can define a first snap receiver 242 and a second snap receiver 244. Each snap receiver 242, 244 can be a void defined in the second snap panel 229. In the current aspect, each snap receiver 232, 234, 242, 244 can be rectangular in shape. In various aspects, various shapes can be utilized in accordance with knowledge of one of skill in the art.

The support assembly panel 270 can comprise a first snap panel 271, a first boxing panel 273, an internal panel 275, a second boxing panel 277, and a second snap panel 279. The first snap panel 271 can be connected to the first boxing panel by a line 281. The first boxing panel 273 can be connected to the internal panel 275 by a line 283. The internal panel 275 can be connected to the second boxing panel 277 by a line 287. The second boxing panel 277 can be connected to the second snap panel 279 by a line 289. In the current aspect, the lines 281, 283, 287, 289 can be bend lines. The first snap panel 271 can define a first snap receiver 282 and a second snap receiver 284. Each snap receiver 282, 284 can be a void defined in the first snap panel 271. Similarly, the second snap panel 279 can define a first snap receiver 292 and a second snap receiver 294. Each snap receiver 292, 294 can be a void defined in the second snap panel 279. In the current aspect, each snap receiver 282, 284, 292, 294 can be rectangular in shape. In various aspects, various shapes can be utilized in accordance with knowledge of one of skill in the art.

The support assembly panel 420 can comprise a first snap panel 421, a first boxing panel 423, an internal panel 425, a second boxing panel 427, and a second snap panel 429. The first snap panel 421 can be connected to the first boxing panel 423 by a line 431. The first boxing panel 423 can be connected to the internal panel 425 by a line 433. The internal panel 425 can be connected to the second boxing panel 427 by a line 437. The second boxing panel 427 can be connected to the second snap panel 429 by a line 439. In the current aspect, the lines 431, 433, 437, 439 can be bend lines. The first snap panel 421 can define a first snap receiver 432 and a second snap receiver 434. Each snap receiver 432, 434 can be a void defined in the first snap panel 421. Similarly, the second snap panel 429 can define a first snap receiver 442 and a second snap receiver 444. Each snap receiver 442, 444 can be a void defined in the second snap panel 429. In the current aspect, each snap receiver 432, 434, 442, 444 can be rectangular in shape. In various aspects, various shapes can be utilized in accordance with knowledge of one of skill in the art.

The support assembly panel 470 can comprise a first snap panel 471, a first boxing panel 473, an internal panel 475, a second boxing panel 477, and a second snap panel 479. The first snap panel 471 can be connected to the first boxing panel by a line 481. The first boxing panel 473 can be connected to the internal panel 475 by a line 483. The internal panel 475 can be connected to the second boxing panel 477 by a line 487. The second boxing panel 477 can be connected to the second snap panel 479 by a line 489. In the current aspect, the lines 481, 483, 487, 489 can be bend lines. The first snap panel 471 can define a first snap receiver 482 and a second snap receiver 484. Each snap receiver 482, 484 can be a void defined in the first snap panel 471. Similarly, the second snap panel 479 can define a first snap receiver 492 and a second snap receiver 494. Each snap receiver 492, 494 can be a void defined in the second snap panel 479. In the current aspect, each snap receiver 482, 484, 492, 494 can be rectangular in shape. In various aspects, various shapes can be utilized in accordance with knowledge of one of skill in the art.

In various aspects, the blank 1000 can be comprised of corrugated cardboard, as previously noted. In some aspects, the corrugation direction of the cardboard can be aligned with a particular direction to increase strength in that direction. As such, in various aspects, the corrugation direction can be aligned with lines 106, 108, 222, 272, 422, and 472, among others. Such arrangement need not be present in all aspects of the current disclosure.

Various dimensions can be utilized in various aspects of the current disclosure. The bottom panel 100 can be of a width 192 of about 47 and 11/16 inches. The bottom panel 100 can be of a length 193 of about 21 and 1/16 inches. Each end panel 600, 800 can be of a width 194 of about 14 and 1/8 inches. An overall width 195 of the blank 1000 can be about 75 and 15/16 inches. An overall length 196 of the blank 1000 can be about 49 and 5/16 inches.

As previously mentioned, the corrugation direction can be aligned with the "length" direction, generally being parallel to length 196 and length 193. In assembly, such a corrugation direction can assist with structural integrity when stacking the resultant packaging.

Figure 2:
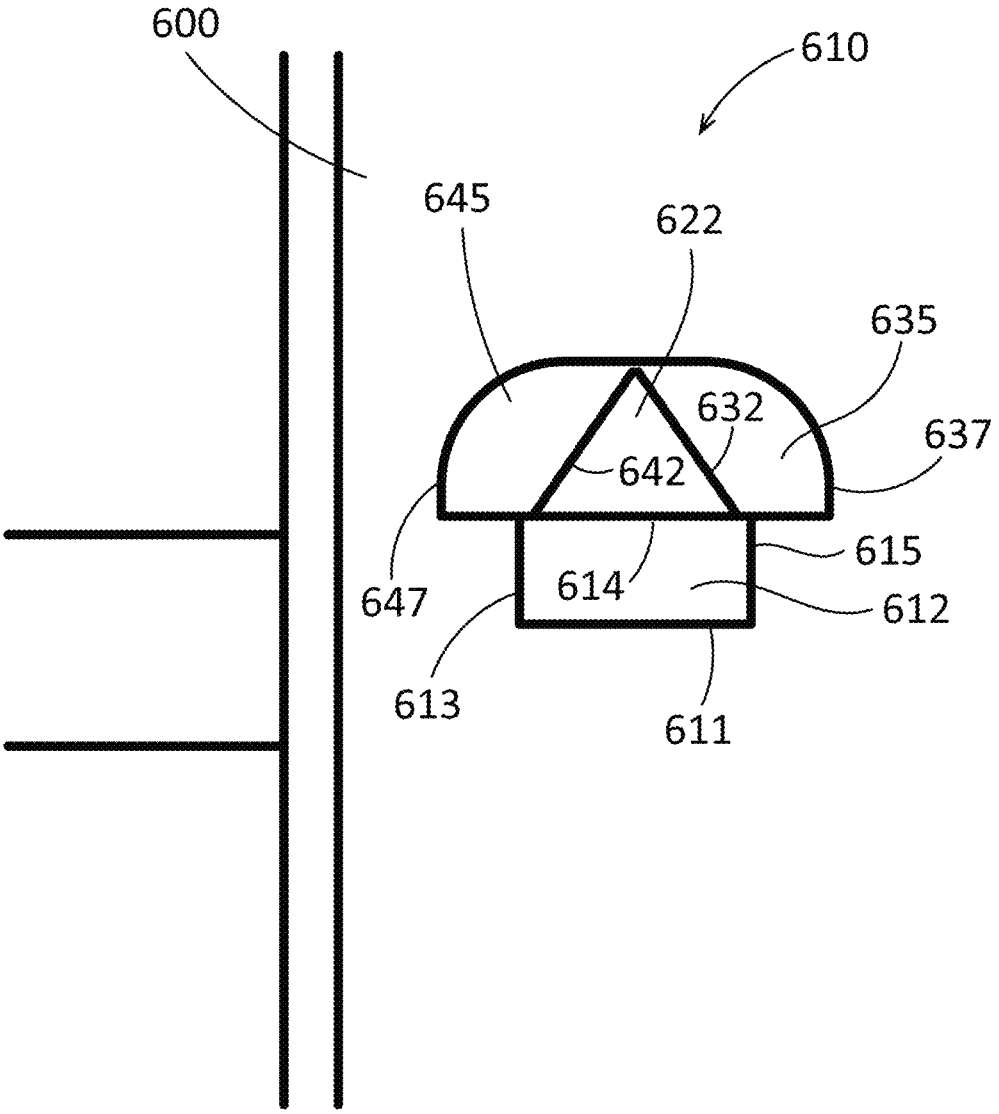
FIG. 2 is a detail view of detail 2 as seen in FIG. 1.

The end panel 600 can comprise a plurality of snaps 610 (labeled as 610*a*, 610*b*, 610*c*, and 610*d*). The end panel 800 can comprise a plurality of snaps 810 (labeled as 810*a*, 810*b*, 810*c*, and 810*d*). A view of the snap 610 that is representative of all snaps 610, 810 can be seen with reference to FIG. 2. Although snap 610*c* is shown with respect to FIG. 2, the snap 610*c* in the current aspect can be representative of all the snaps 610*a,b,c,d* and 810*a,b,c,d* in the current aspect. In the current aspect, the snap 610 can comprise a plurality of bend lines and a plurality of cut lines. Cut lines represent locations of separation of the varying elements shown touching the cut line, such that the elements can be movable in space with respect to one another. Bend lines, as previously described, can be locations where the elements are not separated from one another and are simply bent with respect to one another.

The snap 610 of the current aspect can be designed to be inserted in the snap receivers (232, 234, 242, 244, 282, 284, 292, 294, 432, 434, 442, 444, 482, 484, 492, 494). Each snap 610 can comprise a stub 612 connected to the end panel 600 by bend line 611. Cut lines 613, 615 can be arranged on sides of the stub 612. The stub 612 can be connected to a central portion 622 by a bend line 614. The stub 612 can be rectangular in the current aspect and defined by bend lines 611, 614 and cut lines 613, 615. In various aspects, various shapes can be utilized as would be understood by one of skill in the art.

The central portion 622 of the snap 610 can be about triangular in shape. The central portion 622 can be connected to a first side portion 635 by a bend line 632. The central portion 622 can be connected to a second side portion 645 by a bend line 642. Each side portion 635, 645 can be shaped and arranged extending away from the central portion 622 and outside of a width of the stub 612. A cut line 637 can extend around the perimeter of the first side portion 635 to define a separable border with the end panel 600. Similarly, a cut line 647 can extend around the perimeter of the first side portion 645 to define a separable border with the end panel 600.

Because of the triangular shape of the central portion 622, bend lines 632, 642 can allow the side portions 635, 645 to be bent inwardly toward the central portion 622 and stub 612. Shape memory in the material of the blank 1000 can bias the side portions 635, 645 toward opening. As such, each snap 610 (and 810) of the current aspect can be utilized as a way of connecting the end panels 600, 800 to the snap receivers (232, 234, 242, 244, 282, 284, 292, 294, 432, 434, 442, 444, 482, 484, 492, 494).

Figure 3:
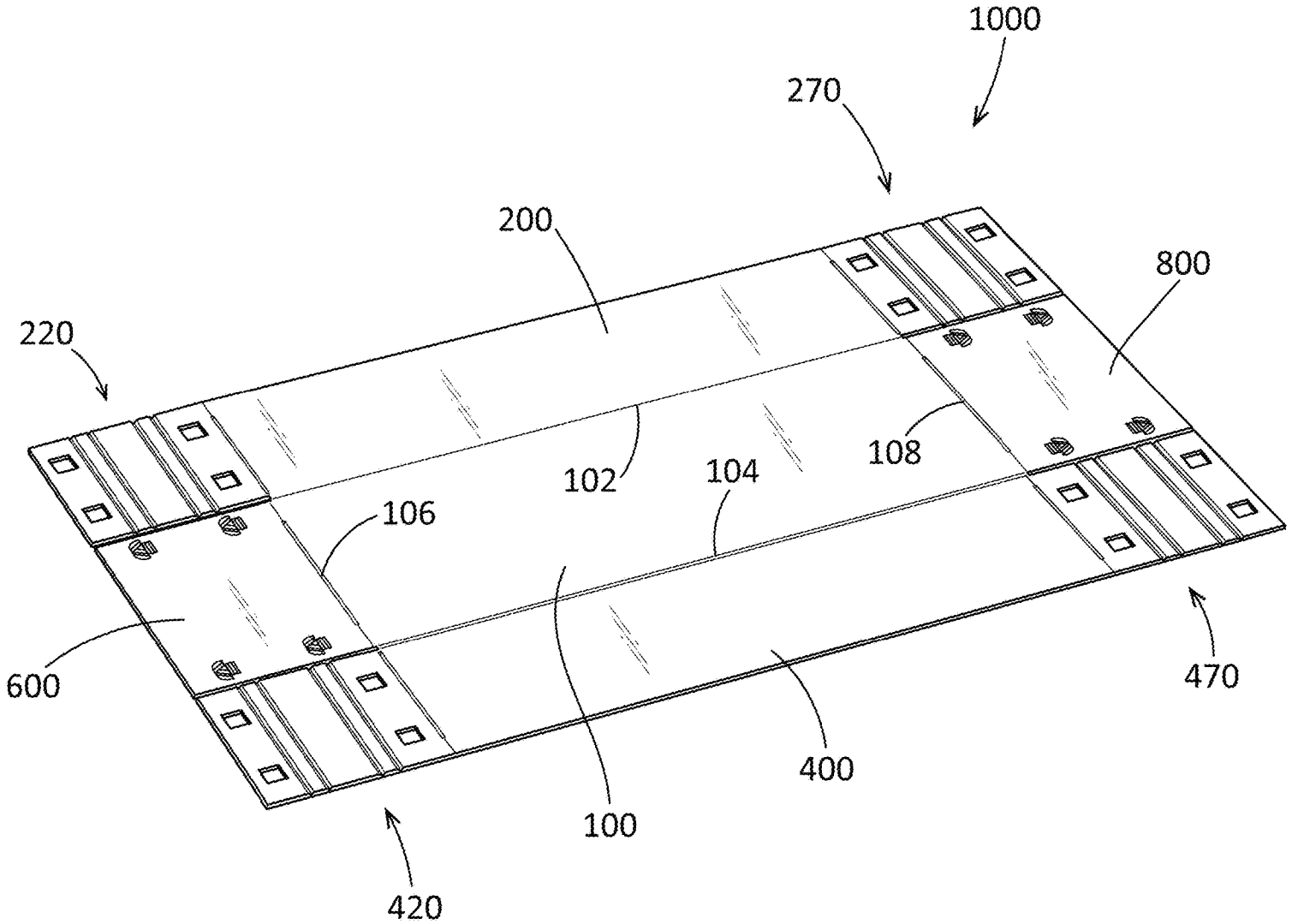
FIG. 3 is a perspective view of the blank of FIG. 1 before assembly into the tray.
Figure 4:
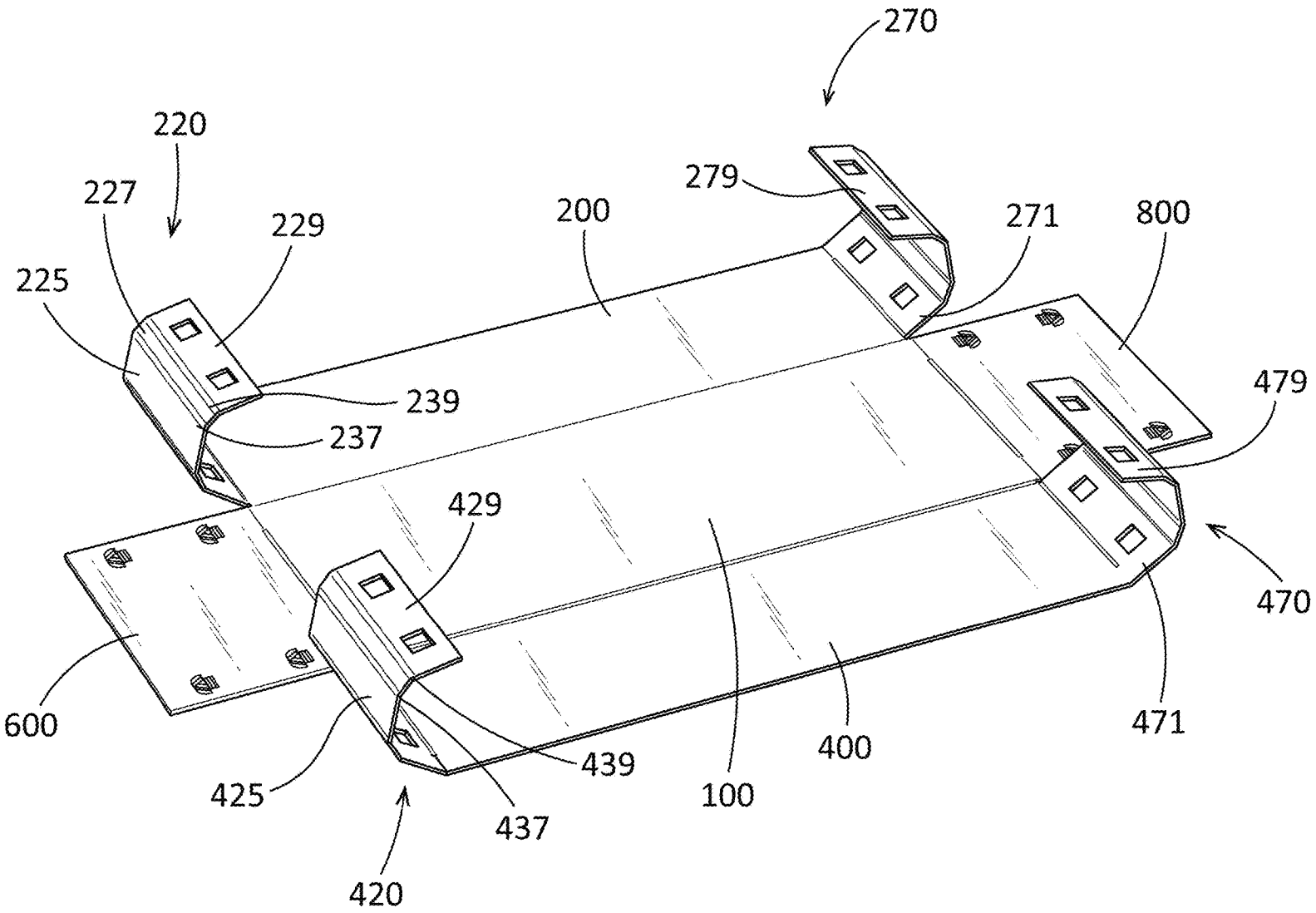
FIG. 4 is a perspective view of the blank of FIG. 1 in a first step of assembly into the tray.

Assembly and use steps can be followed with reference to the following discussion. As seen with reference to FIG. 3, the blank 1000 can be laid out and prepared for assembly. With reference to FIG. 4, the first step of assembly can comprise forming support assemblies 220', 270', 420', 470' from support assembly panels 220, 270, 420, 470, respectively. The support assembly panels 220, 270 can be rolled up into support assemblies 220', 270' as an initial step. Each line 231, 233, 237, 239 in support assembly panel 220 can be used to bend the various panels 221, 223, 225, 227, 229 of the support assembly panel 220 with respect to one another. Simultaneously, each line 431, 433, 437, 439 in support assembly panel 420 can be used to bend the various panels 421, 423, 425, 427, 429 of the support assembly panel 420 with respect to one another. The support assembly panel 220 can be bent such that the first snap panel 221 can be in contact with the second snap panel 229 such that an inner surface of the first snap panel 221 can be in contact with an outer surface of the second snap panel 229. Similarly, the support assembly panel 420 can be bent such that the first snap panel 421 can be in contact with the second snap panel 429 such that an inner surface of the first snap panel 421 can be in contact with an outer surface of the second snap panel 429. In assembly, similar steps can be performed with the support assembly panels 270, 470 at the initial stage or later in the assembly process.

Figure 5:
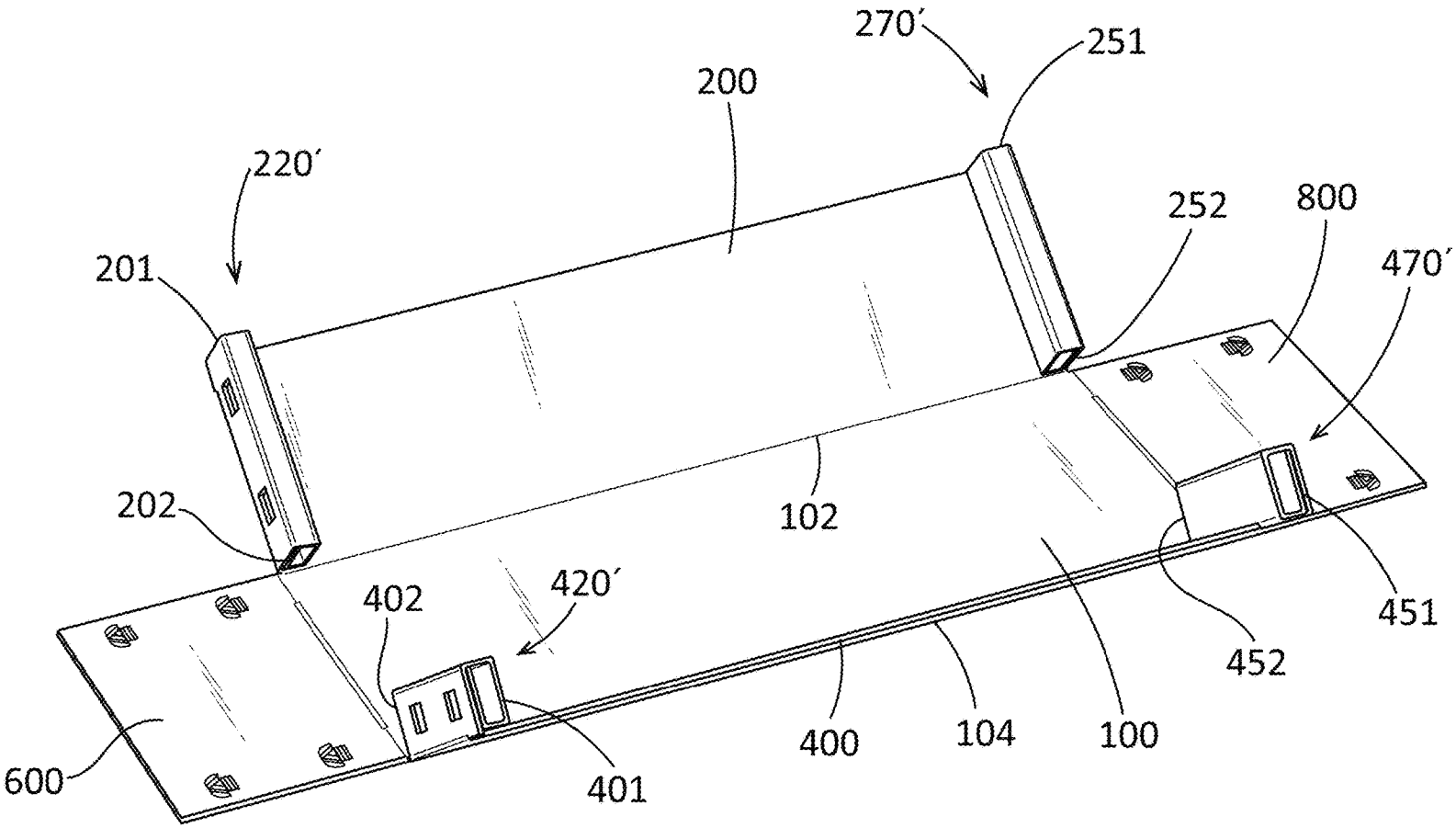
FIG. 5 is a perspective view of the blank of FIG. 1 in a next step of assembly into the tray.

As seen with reference to FIG. 5, the support assemblies 220', 270', 420', 470' can be seen in full formation. Each side panel 200, 400 can then be seen being bent along lines 102, 104, respectively. The formed support assembly 220' can define a top end 201 and a bottom end 202. The formed support assembly 420' can define a top end 401 and a bottom end 402. The formed support assembly 270' can define a top end 251 and a bottom end 252. The formed support assembly 470' can define a top end 451 and a bottom end 452. When the side panels 200, 400 are bent along lines 102, 104, the bottom ends 202, 252, 402, 452 can become in contact with the bottom panel 100.

Figure 6:
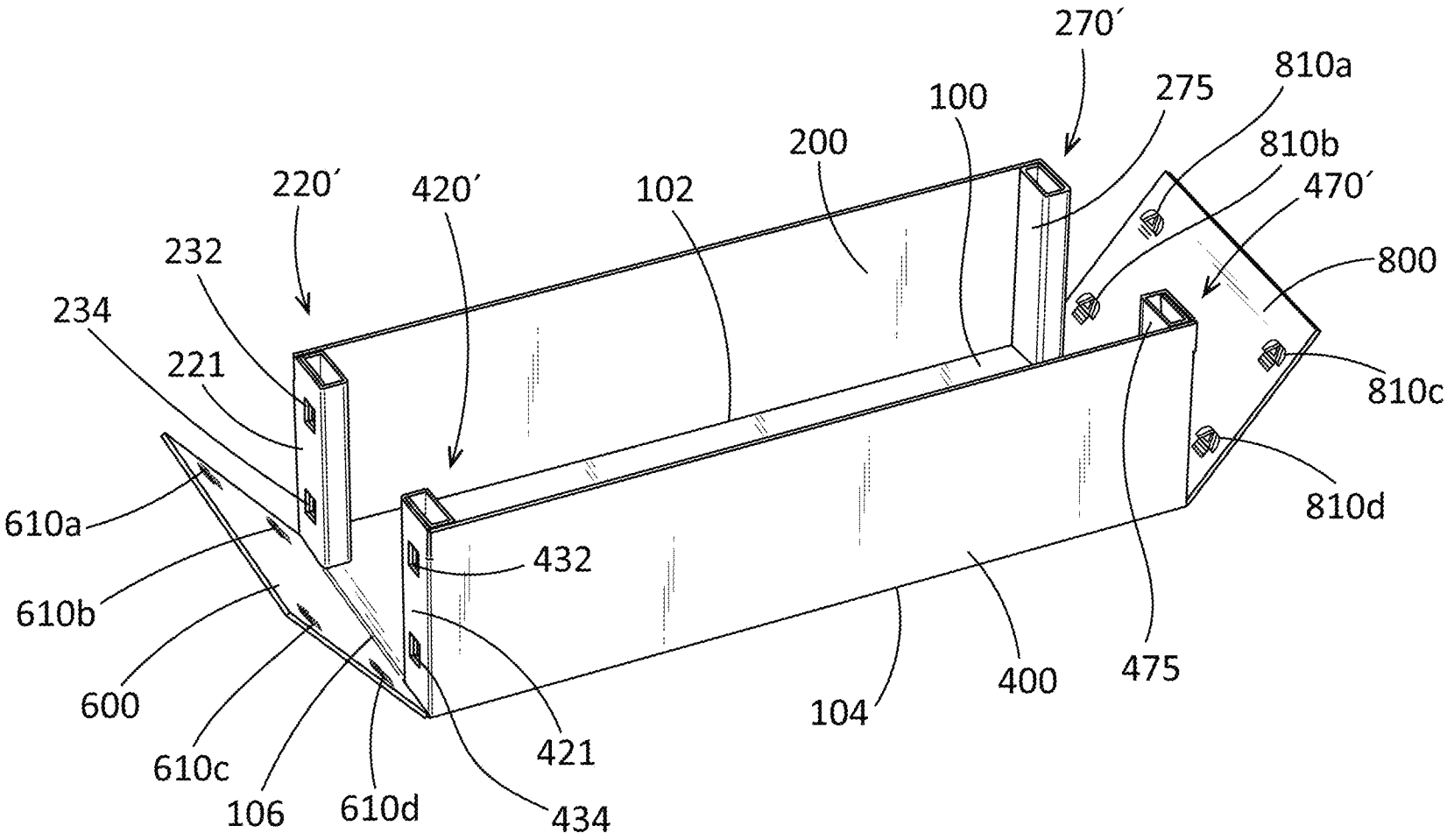
FIG. 6 is a perspective view of the blank of FIG. 1 in a next step of assembly into the tray.

As seen with reference to FIG. 6, the side panels 200, 400 can be arranged orthogonally to the bottom panel 100 with the bottom ends 202, 252, 402, 452 (not shown in the current view) in contact with the bottom panel 100. The next assembly step can be bending the end panels 600, 800 with respect to the bottom 100 along lines 106, 108, respectively. In doing so, an inner surface of the end panel 600 can become in contact with an outer surface of snap panels 221, 421. If arranged correctly, the snaps 610*a*, 610*b* can be aligned with the snap receivers 232, 234, respectively, and the snaps 610*c*, 610*d* can be aligned with the snap receivers 432, 434, respectively. Similarly, an inner surface of the end panel 800 can become in contact with an outer surface of snap panels 271, 471 (not shown in the current view). If arranged correctly, the snaps 810*a*, 810*b* can be aligned with the snap receivers 282, 284 (not shown in the current view), respectively, and the snaps 810*c*, 810*d* can be aligned with the snap receivers 482, 484 (not shown in the current view), respectively.

It should also be noted that the second snap panels 229, 429, 279, 479 can be aligned with and in contact with the first snap panels 221, 421, 271, 471. As such, the snap receivers 242, 244 can be aligned with the snap receivers 232, 234, respectively. The snap receivers 442, 444 can be aligned with the snap receivers 432, 434, respectively. The snap receivers 292, 294 can be aligned with the snap receivers 282, 284, respectively. The snap receivers 492, 494 can be aligned with the snap receivers 482, 484, respectively. As such, each of the snaps 610*a,b,c,d* and 810*a,b,c,d* can be aligned with two snap receivers (232, 234, 242, 244, 282, 284, 292, 294, 432, 434, 442, 444, 482, 484, 492, 494) at the same time.

Figure 7:
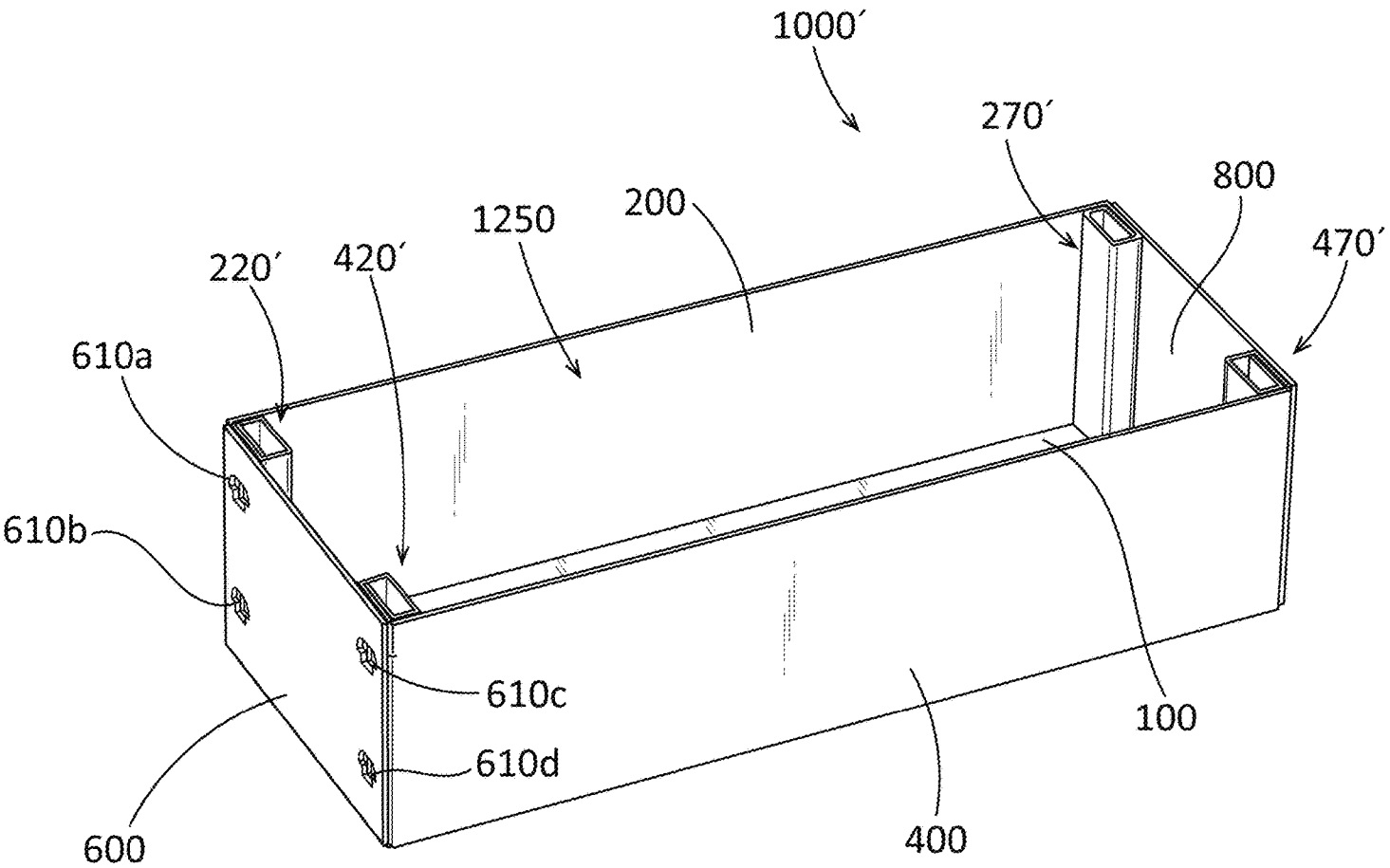
FIG. 7 is a perspective view of the tray having been formed from the blank of FIG. 1 in accordance with one aspect of the current disclosure.

As seen with reference to FIG. 7, a completed tray 1000' can be formed by arranging the packaging from the blank 1000 as described herein. Each side panel 200, 400 can be arranged orthogonally to the bottom panel 100. Each support assembly 220', 270', 420', 470' can be formed from one support assembly panel 220, 270, 420, 470 to provide structural support at corners of the resultant tray 1000'. As previously mentioned, the corrugation direction can be aligned along the length direction (as previously noted, being parallel to length 193 and length 196). As such, the corrugations can be arranged to run with the long direction of each support assembly 220', 270', 420', 470'. As such, the corrugations can provide additional structural support in the corners of the tray 1000'. The end panel 600 can be secured to the support assemblies 220', 420' by forcing portions of the snaps 610*a*, 610*b*, 610*c*, 610*d* through snap receivers 232, 234, 432, 434, respectively. Additionally, because of the aligned of the snap receivers (232, 234, 242, 244, 282, 284, 292, 294, 432, 434, 442, 444, 482, 484, 492, 494) as previously discussed, each of the snaps 610*a*, 610*b*, 610*c*, 610*d* can also be forced through the snap receivers 242, 244, 442, 444, respectively, in addition to the snap receivers 232, 234, 432, 434, respectively. The side portions 635, 645 (shown with reference to FIG. 2) can be bent inwardly to be forced through the various snap receivers (232, 234, 242, 244, 282, 284, 292, 294, 432, 434, 442, 444, 482, 484, 492, 494). Once inserted, each side portion 635, 645 can be allowed to expand, thereby trapping each snap 610 within the snap receiver (232, 234, 242, 244, 282, 284, 292, 294, 432, 434, 442, 444, 482, 484, 492, 494) associated with that snap 610*a*, 610*b*, 610*c*, 610*d*, 810*a*, 810*b*, 810*c*, 810*d*. Connections between the various snaps 610, 810 and the snap receivers (232, 234, 242, 244, 282, 284, 292, 294, 432, 434, 442, 444, 482, 484, 492, 494) can be termed snap connections in accord with the current disclosure. As such, the end panels 600, 800 can be secured to the remaining portions of the tray 1000' thereby providing a secure packaging element with structural support. The formed tray 1000' can define an opening 1250. The opening can be defined by the ends of each side panel 200, 400 and each end panel 600, 800.

Figure 8:
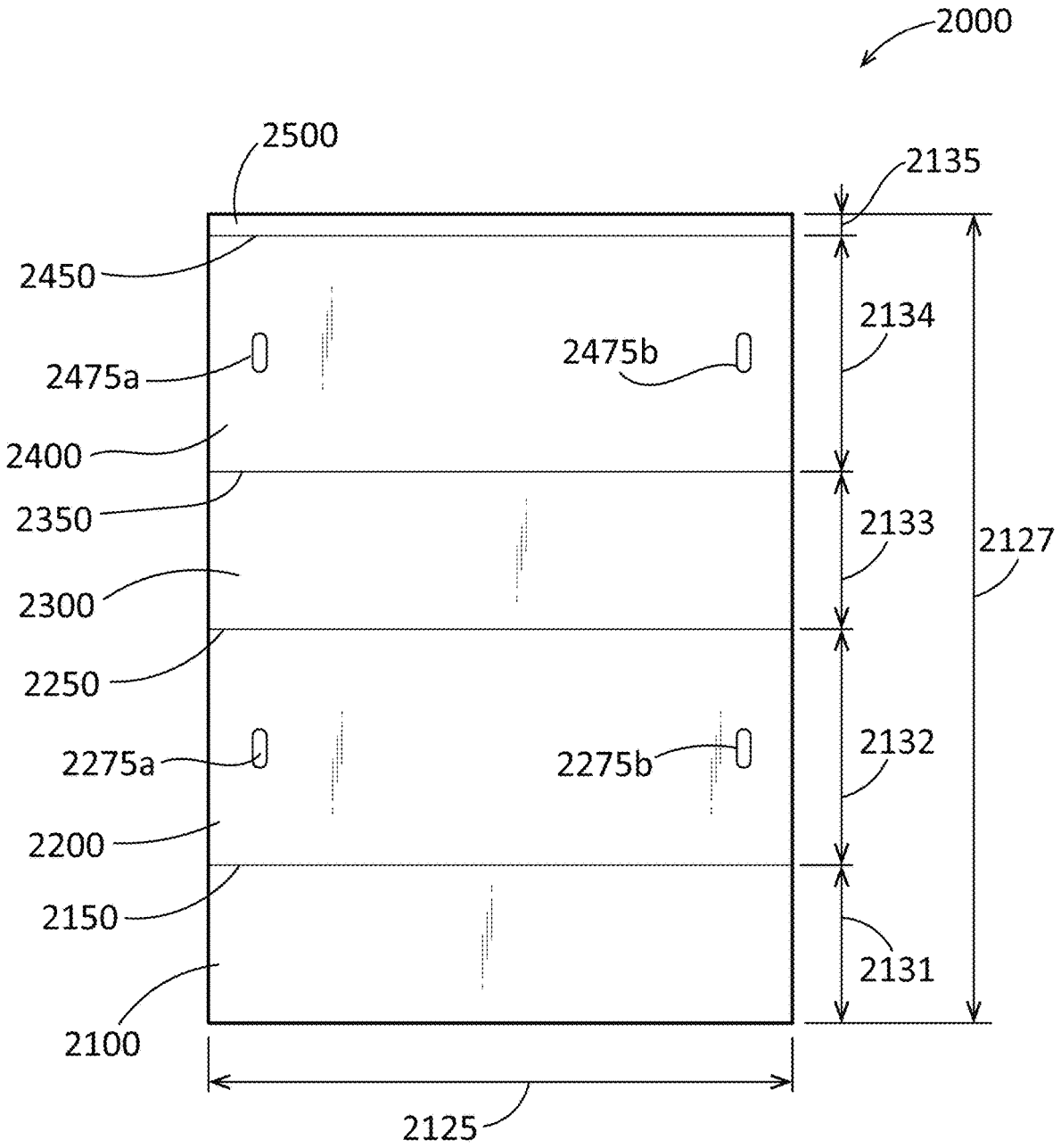
FIG. 8 is a plan view of a blank formable into a sleeve in accord with one aspect of the current disclosure.

As seen with reference to FIG. 8, a sleeve blank 2000 can be seen. The sleeve blank 2000 can have a first side panel 2100 connected to a second side panel 2200 by a line 2150. The second side panel 2200 can be connected to a third side panel 2300 by a line 2250. The third side panel 2300 can be connected to a fourth side panel 2400 by a line 2350. The fourth side panel 2400 can be connected to a connection panel 2500 by a line 2450. The connection panel 2500 can be side and arranged to be affixed to or connected to the first side panel 2100 during assembly. The second side panel 2200 can define a pair of handle cutouts 2275*a,b*. The fourth side panel 2400 can define a pair of handle cutouts 2475*a,b*.

Figure 9:
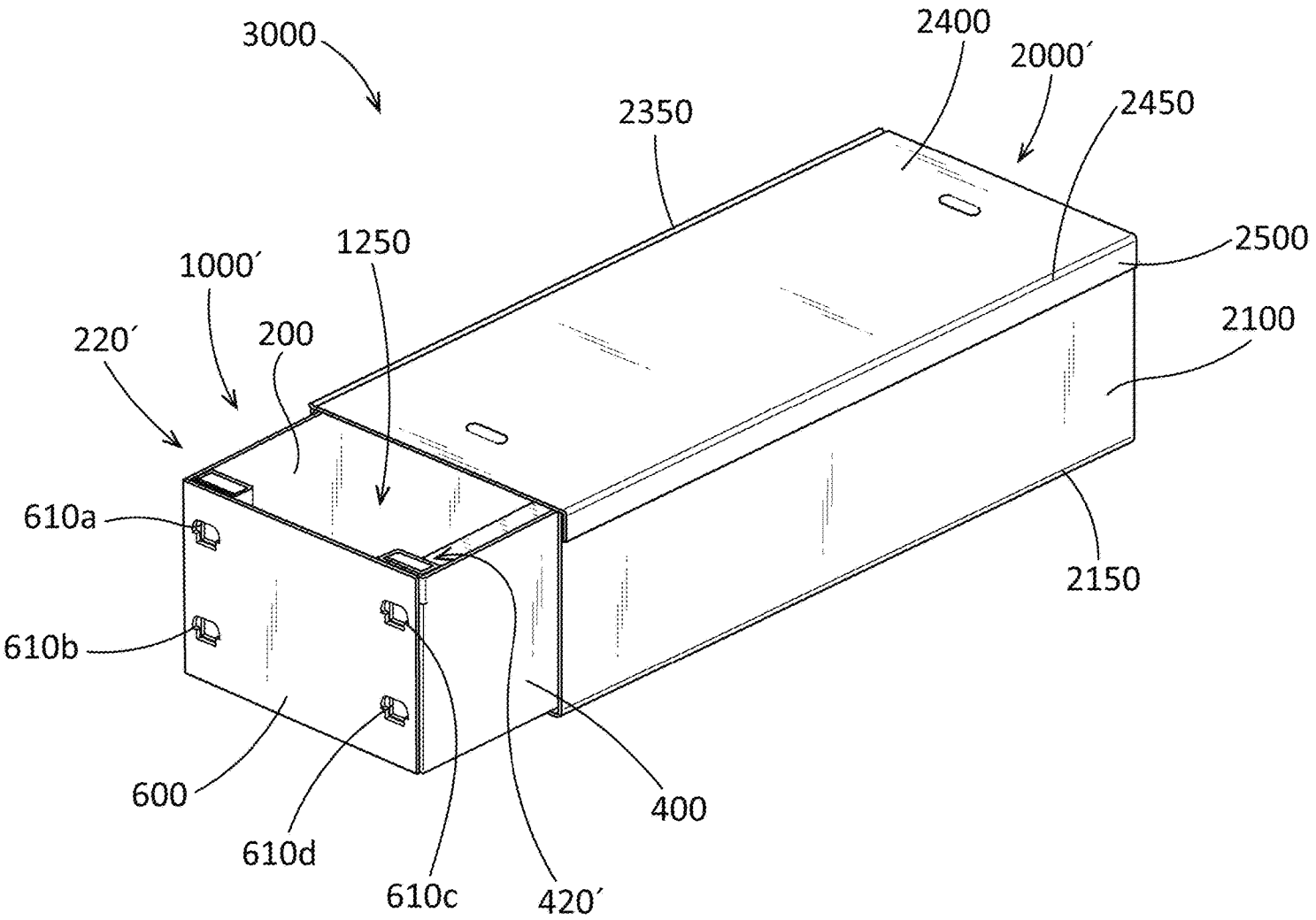
FIG. 9 is a perspective view of a packaging assembly incorporating the tray of FIG. 7 and a sleeve formed from the blank of FIG. 8.

In various aspects, the various panels 2100, 2200, 2300, 2400, 2500 can be of various sizes. One of skill in the art would understand that dimensions of various panels need not be particular lengths and that various lengths cited herein are provided for exemplary purposes only. In the current aspect, all of the panels 2100, 2200, 2300, 2400, 2500 can be of the same width 2125. In the current aspect, the width 2125 can be about 48 inches. An overall length 2127 can define the overall dimension of the sleeve blank 2000. In the current aspect, the overall length 2127 can be about 74 and 11/16 inches. Lengths of the various panels can be of various sizes. In the current aspect, similarity of size between the first side panel 2100 and the third side panel 2300 along with the similarity of size between the second side panel 2200 and the fourth side panel 2400 can lead to a roughly rectangular cross-sectional shape of the packaging element formed from the sleeve blank 2000. A length 2131 of the first side panel 2100 can be about 14 and one half inches. A length 2132 of the second side panel 2200 can be about 21 and 11/16 inches. A length 2133 of the third side panel 2300 can be about 14 and 11/16 inches. A length 2134 of the fourth side panel 2400 can be about 21 and 13/16 inches. A length 2135 of the connection panel 2500 can be about two inches. In the current aspect, the direction of the corrugations can be parallel to the direction in which lengths (such as overall length 2127) are measured. Having the corrugations pointed in the direction cited can aid in providing structural integrity for stacking when assembled. As seen with reference to FIG. 9, a sleeve 2000' can be formed from the sleeve blank 2000. The sleeve 2000' can be arranged by affixing the connection panel 2500 to the first side panel 2100. In various aspects, tape or adhesive can be used to affix the connection panel 2500 to the first side panel 2100. The sleeve 2000' can be arranged also by receiving a flattened sleeve 2000' from a manufacturer wherein the connection panel 2500 can already be attached to the first side panel 2100. In such situations, the sleeve 2000' can be arranged in a flattened position, wherein the first side panel 2100 can be coplanar with the second side panel 2200 and no bend along line 2150; similarly, the third side panel 2300 can be coplanar with the fourth side panel 2400 with no bend along line 2350. The second side panel 2200 can be bent with respect to the third side panel 2300 along line 2250; similarly, the first side panel 2100 can be bent with respect to the fourth side panel 2400, the first side panel 2100 being affixed to the connection panel 2500 with a bend along line 2450. A customer can receive the sleeve 2000' in such a collapsed arrangement and can expand the sleeve 2000' into the shape seen in FIG. 9

The tray 1000' can be arranged inside a sleeve 2000'. Together, the tray 1000' and the sleeve 2000' can combine to form a packaging assembly 3000. The sleeve 2000' can provide a cover to the tray 1000' such that the opening 1250 can be covered.

Figure 10:
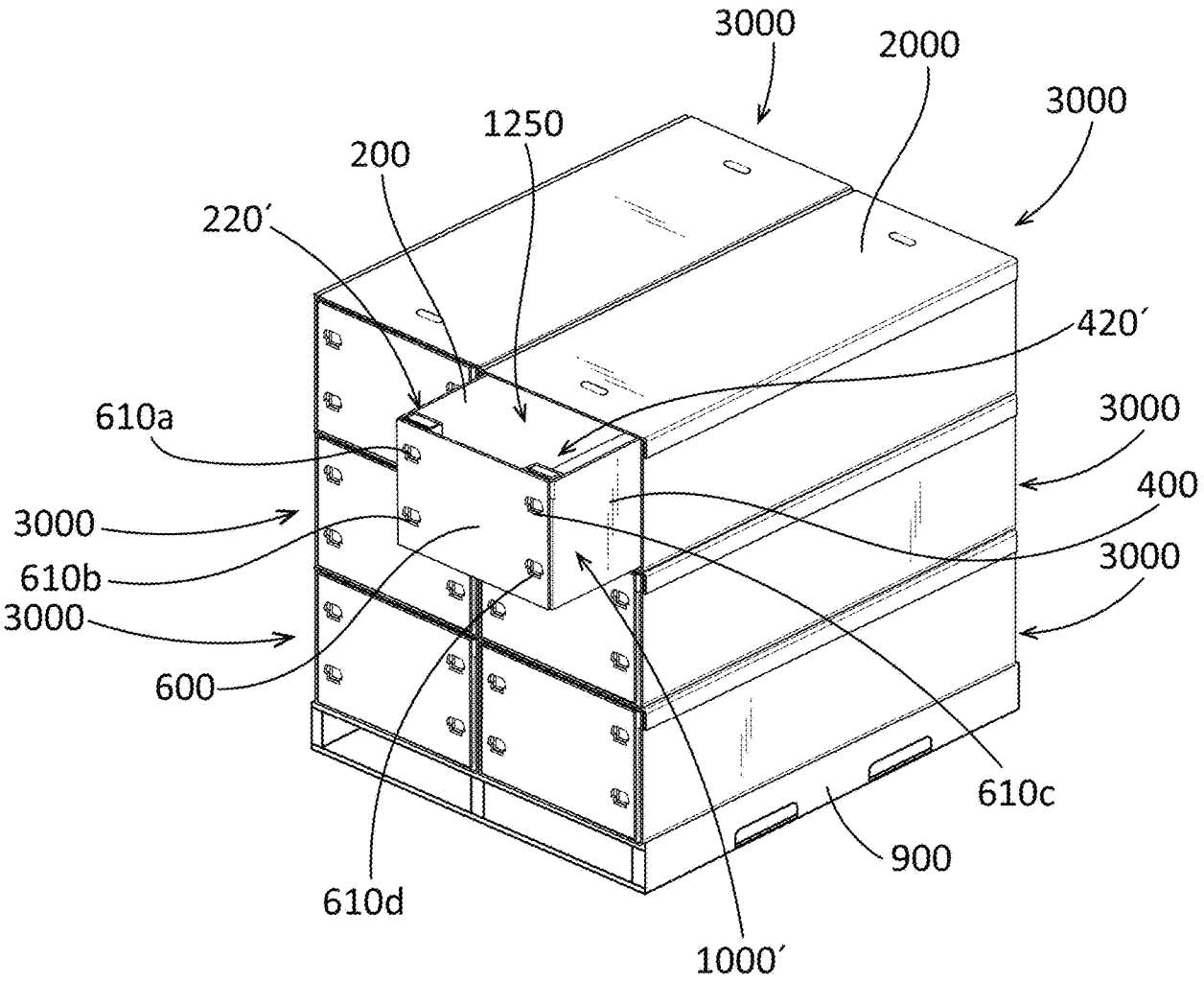
FIG. 10 is a perspective view of an array of packaging assemblies being stacked on a pallet, each packaging assembly including the tray of FIG. 7.

As seen with reference to FIG. 10, multiple packaging assemblies 3000 can be stacked for ease of storage or movement. In the current view, packaging assemblies 3000 can be stacked on a pallet 900. The pallet 900 can then be moved by a pallet jack (not shown) as would be understood by one of skill in the art, thereby allowing movement of multiple items contained within the various packaging assemblies 3000.

In the current view, one tray 1000' can be seen telescoping out of one sleeve 2000' as part of the packaging assembly 3000. A feature that can be included as part of the packaging assembly 3000 can allow the tray 1000' can be pulled away from the sleeve 2000' as one would open a drawer.

In various aspects, the tray 1000' can allow packing or unpacking through the opening 1250. In various aspects, however, the tray 1000' can be utilized for top load and side unloading, as seen with reference to FIGS. 11-12.

Figure 11:
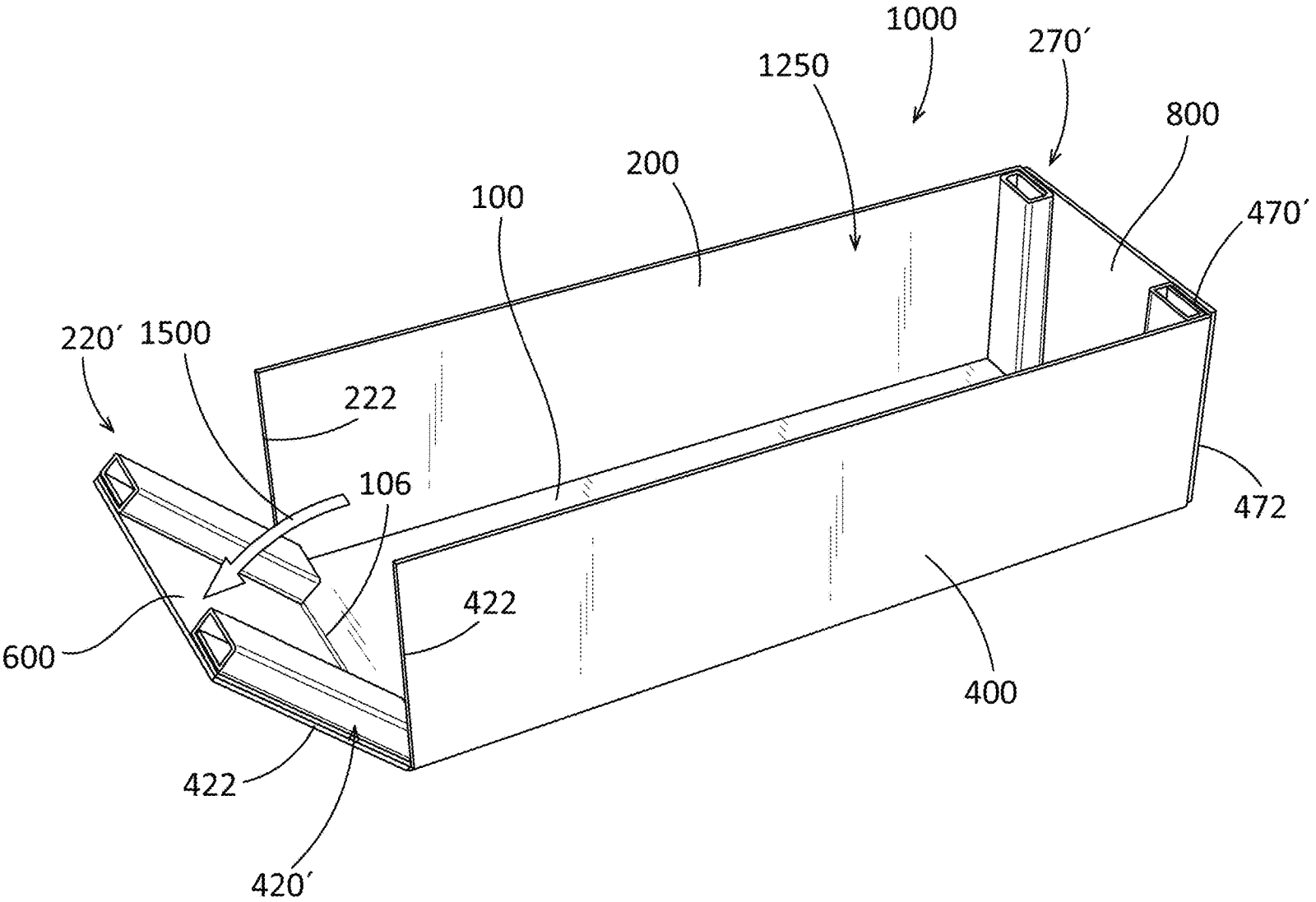
FIG. 11 is a perspective view of the tray of FIG. 7 showing one method for opening the tray.
Figure 12:
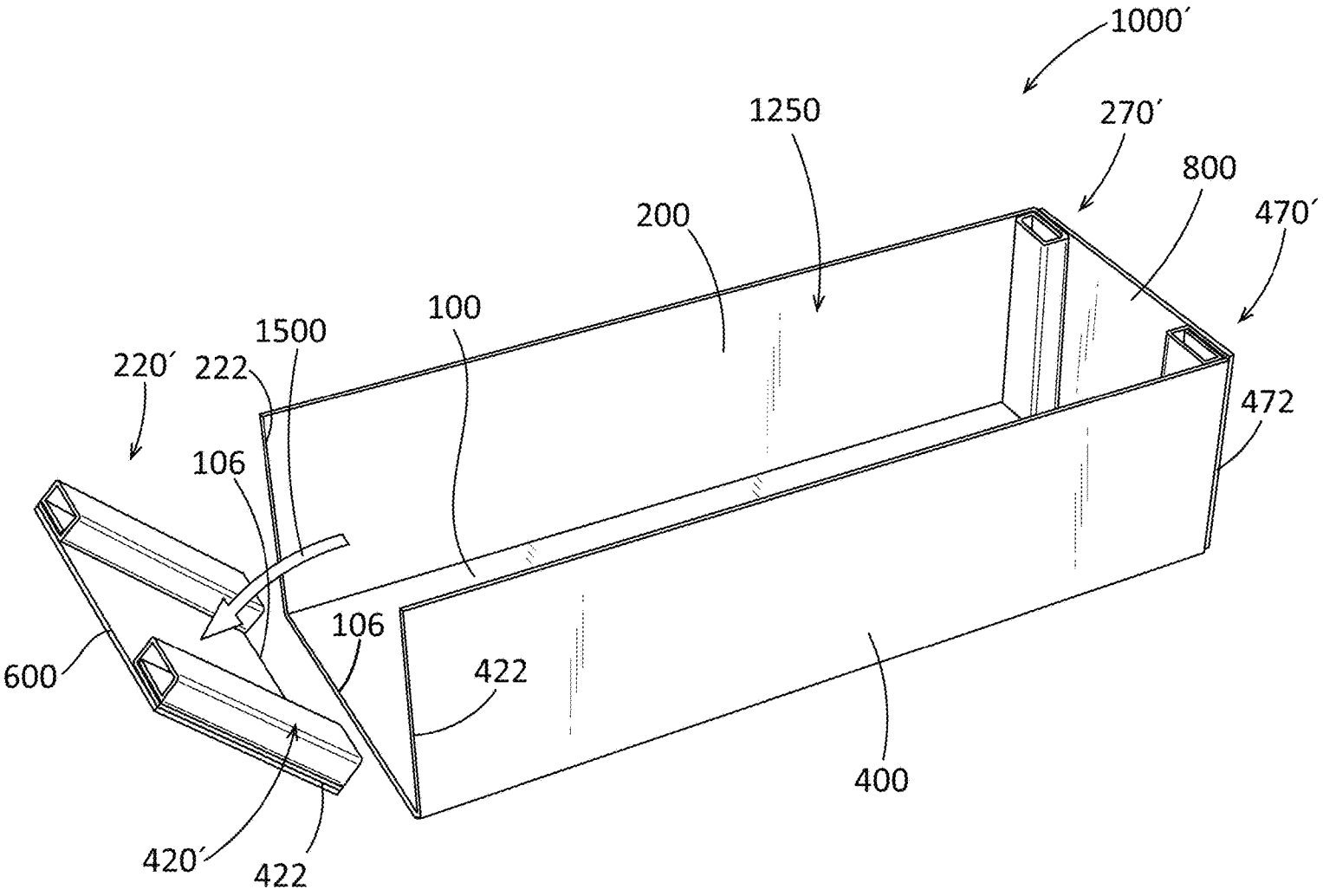
FIG. 12 is a perspective view of the tray of FIG. 7 showing another method for opening the tray.

As seen with specific reference to FIG. 11, contents of the tray 1000' can be accessed by permanent removal of one of the end panels 600, 800 and various of the support assemblies 220', 270', 420', 470'. As mentioned previously, the lines 106, 108 connecting each end panel 600, 800, respectively, to the bottom panel 100 can be perforated in various aspects. Additionally, lines 222, 272, 422, 472 can also be perforated in various aspects. Each line 222, 272, 422, 472 can be the connection line between one of the support assemblies 220', 270', 420', 470' and one of the side panels 200, 400. As previously discussed, perforations such as those noted herein can be arranged such that the elements connected by the perforations can be separated with sufficient force applied. When force 1500 is applied to the end panel 600, the end panel 600 can be separated from the tray 1000'. In various aspects, the force 1500 can separate the end panel 600 connections along lines 222, 422 initially, as shown with reference to FIG. 11. In various aspects, force 1500 can separate the end panel 600 as well as the support assemblies 220', 420', as shown with reference to FIG. 12. In this way, contents of the packaging assembly 3000—and, specifically, of the tray 1000'—can be accessed from the side, meaning that heavier contents in the packaging need not be lifted out of the opening 1250.

Because of the support structure afforded by the design described herein, heavy elements can be top loaded into the trays 1000'. The trays 1000' can then be arranged with the sleeves 2000' to form packaging assemblies 3000. Because of support assemblies 220', 270', 420', 470', multiple packaging assemblies 3000 can be stacked, even when the contents of the packaging assemblies 3000 are heavy. Additional support elements such as corner braces or wood brackets can be omitted entirely in various aspects—such as those shown and described herein—or can be minimized in other aspects. As such, the blank 1000 can be utilized to form a structurally secure packaging assembly 3000 without added fasteners or structural elements other than the sleeve 2000'. Such packaging assembly 3000 can be low production cost with minimal assembly steps and supplies while maintaining the structural integrity needed to stack heavy elements that can be contained within such packaging assembly 3000.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A blank comprising:

a bottom panel;

at least one side panel connected to the bottom panel, each side panel connected to the bottom panel by a side panel line;

at least one support assembly panel, each support assembly panel connected to one side panel by a support assembly line; and, at least one end panel connected to the bottom panel by an end panel line, wherein each support assembly panel comprises:

a first snap panel connected to one side panel by the support assembly line;

at least one intermediary snap panel connected as part of the support assembly panel in bending relationship with the first snap panel; and a second snap panel distal to the first snap panel and connected as part of the support assembly panel in bending relationship with the at least one intermediary snap panel, wherein each end panel is removably connected to the bottom panel by the end panel line, wherein at least one support assembly panel defines a snap receiver.

2. The blank of claim 1, wherein each support assembly panel is removably connected to one side panel by the support assembly line.

3. The blank of claim 2, wherein each end panel line is perforated.

4. The blank of claim 3, wherein each support assembly line is perforated.

5. The blank of claim 1, wherein the first snap panel of at least one support assembly panel defines the snap receiver.

6. The blank of claim 1, wherein at least one snap is defined by a portion of the blank that is outside of the first snap panel.

7. The blank of claim 6, wherein each snap comprises a stub connected to a first side portion and a second side portion.

8. The blank of claim 1, the blank defining at least one snap and at least one snap receiver.

9. The blank of claim 1, wherein the blank comprises corrugated cardboard.

10. The blank of claim 1, wherein each snap receiver is a void defined in the support assembly panel.

11. A packaging formed from a blank, the packaging comprising:

a bottom panel;

a side panel connected to the bottom panel;

a support assembly connected to the side panel, the support assembly configured to be separable from the side panel; and an end panel connected to the bottom panel, the end panel configured to be separable from the bottom panel, wherein the support assembly is configured to allow the packaging to be stackable, wherein the support assembly is configured to be separable from the packaging.

12. The packaging of claim 11, wherein the end panel contacts the support assembly.

13. The packaging of claim 11, wherein the support assembly defines a snap receiver, wherein a snap is positioned within the snap receiver.

14. The packaging of claim 11, wherein the support assembly is a first support assembly, wherein the packaging comprises a second support assembly, wherein the end panel contacts the first support assembly and the second support assembly.

15. The packaging of claim 14, wherein the end panel is connected to the bottom panel by a perforated line such that the end panel is forcibly separable from the bottom panel.

16. The packaging of claim 15, wherein the first support assembly is connected to the side panel by a perforated line such that the first support assembly is forcibly separable from the side panel.

17. The packaging of claim 11, wherein the side panel is a first side panel connected to the bottom panel and wherein a second side panel is arranged opposite to and facing the first side panel.

18. The packaging of claim 17, wherein the support assembly is a first support assembly, wherein the packaging comprises a second support assembly, and wherein the end panel contacts the first support assembly and the second support assembly.

19. The packaging of claim 18, wherein the first support assembly is connected to the first side panel and the second support assembly is connected to the second side panel.

20. The packaging of claim 11, wherein the packaging comprises at least one snap, each snap arranged to be coupled to one snap receiver.

21. The packaging of claim 11, wherein the blank is formed of corrugated cardboard.

22. A packaging element comprising:

a bottom panel, the bottom panel being rectangular;

a first side panel arranged orthogonally to the bottom panel;

a second side panel arranged orthogonally to the bottom panel and opposite the first side panel, wherein an opening is defined between the first side panel and the second side panel;

a first support assembly releasably connected to the first side panel and configured to be positioned between the bottom panel and a cover of the opening;

a second support assembly releasably connected to the second side panel and configured to be positioned between the bottom panel and the cover;

an end panel releasably connected to the bottom panel, wherein the first support assembly and the second support assembly are configured to allow the packaging to be stackable only when the first support assembly is connected to the first side panel and the second support assembly is connected to the second side panel.

23. The packaging element of claim 22, wherein the first support assembly is releasably connected to the first side panel by a perforated line, wherein the second support assembly is releasably connected to the second side panel by a perforated line, and wherein the end panel is releasably connected to the bottom panel by a perforated line.

24. The packaging element of claim 22, wherein each of the first side panel and the second side panel are connected to the bottom panel by a bend line.

25. The packaging element of claim 22, wherein each support assembly defines a snap receiver.

26. The packaging element of claim 25, wherein the end panel contacts each of the first support assembly and the second support assembly.

27. The packaging element of claim 26, wherein the end panel is secured to each of the first support assembly and the second support assembly.

28. The packaging element of claim 27, wherein the end panel is secured directly to the first support assembly by a snap engaging the snap receiver.

29. A method of forming packaging, the method comprising:

obtaining a blank, the blank comprising:

a bottom panel;

a side panel connected to the bottom panel by a side panel line;

a support assembly panel connected to the side panel by a support assembly line; and an end panel connected to the bottom panel by an end panel line;

wherein the support assembly panel defines a snap receiver; and, wherein the blank comprises a snap arranged to couple to the snap receiver;

bending the support assembly panel to form a first support assembly;

bending the side panel with respect to the bottom panel along the side panel line such that the side panel is arranged orthogonally with respect to the bottom panel;

bending the end panel with respect to the bottom panel along the end panel line such that the end panel is arranged orthogonally with respect to the bottom panel and in contact with the first support assembly;

securing the end panel in contact with the first support assembly.

30. The method of claim 29, wherein the step of securing the end panel in contact with the first support assembly comprises inserting the snap into the snap receiver.

* * * * *